US010954094B2

(12) United States Patent
Miyahara et al.

(10) Patent No.: US 10,954,094 B2
(45) Date of Patent: Mar. 23, 2021

(54) METHOD OF SWITCHING TRAYS FOR FEEDING INTER SHEETS IN IMAGE FORMING APPARATUS

(71) Applicant: CANON KABUSHIKI KAISHA, Tokyo (JP)

(72) Inventors: Nobuaki Miyahara, Moriya (JP); Takashi Kuroda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 55 days.

(21) Appl. No.: 16/459,058

(22) Filed: Jul. 1, 2019

(65) Prior Publication Data

US 2020/0010299 A1 Jan. 9, 2020

(30) Foreign Application Priority Data

Jul. 5, 2018 (JP) ..... JP2018-128567
Feb. 21, 2019 (JP) ..... JP2019-029567

(51) Int. Cl.
*B65H 39/04* (2006.01)
*B41J 13/00* (2006.01)
*G03G 15/00* (2006.01)

(52) U.S. Cl.
CPC ..... *B65H 39/04* (2013.01); *B41J 13/009* (2013.01); *G03G 15/6552* (2013.01)

(58) Field of Classification Search
CPC ..... B65H 39/04; B65H 37/04; B65H 39/02; B41J 13/009; G03G 15/6552; G03G 15/6538; G03G 15/655
See application file for complete search history.

(56) References Cited

U.S. PATENT DOCUMENTS 4,602,776 A * 7/1986 York ..... B65H 29/60 271/296
7,248,377 B2 * 7/2007 Nimura ..... B65H 33/04 358/1.12
8,038,139 B2 * 10/2011 Nishimura ..... B42C 1/12 270/58.23
8,342,501 B2 * 1/2013 Yoshimura ..... B65H 3/44 271/9.02
9,004,483 B2 * 4/2015 Minamisawa ..... B65H 33/04 271/9.13
9,751,711 B2 * 9/2017 Ogawa ..... B42C 1/12
10,625,970 B2 * 4/2020 Yamamoto ..... B65H 3/44
(Continued)

FOREIGN PATENT DOCUMENTS

JP 2007-168958 A 7/2007

*Primary Examiner* — Patrick H Mackey
(74) *Attorney, Agent, or Firm* — Venable LLP

(57) ABSTRACT

If an inter sheet on a designated feed tray during execution of a print job is lacking, and when a setting received via an operation unit is for a first mode, a control unit switches a feed source from the designated feed tray to another feed tray on which an inter sheet of the same size has been placed and continues the print job, and when the setting is for a second mode, interrupts the print job without switching the feed source from the designated feed tray to another feed tray. In a case where a plurality of feed trays are designated as a feed source, the control unit interrupts the print job without switching the feed source from the feed tray in which the inter sheet is lacking to another feed tray even if the setting is for the first mode.

12 Claims, 8 Drawing Sheets

(56) References Cited

U.S. PATENT DOCUMENTS

2001/0018626 A1* 8/2001 Moriyama ..... G03G 15/655
700/223
2009/0166949 A1* 7/2009 Unno ..... B41J 11/485
271/9.03

* cited by examiner

METHOD OF SWITCHING TRAYS FOR FEEDING INTER SHEETS IN IMAGE FORMING APPARATUS

BACKGROUND OF THE INVENTION

Field of the Invention

The present invention relates to a method for switching trays for feeding inter sheets in an image forming apparatus.

Description of the Related Art

An inserter is a post-processing apparatus that inserts inter sheets into a sheet bundle (group of sheets) on which an image forming apparatus has formed images. The inserter adds a cover sheet to a sheet group, inserts an insertion sheet between two sheets constituting a sheet group, and inserts a partition sheet between a sheet group formed by a preceding job and a sheet group formed by a succeeding job. The inserter inserts inter sheets stacked on a feed tray into the sheet group. When there are no inter sheets stacked on a respective feed tray, the image forming apparatus has to interrupt image formation. In Japanese Patent Laid-Open No. 2007-168958, an inserter having a plurality of feed trays has been proposed. When there is no inter sheet in one of the feed trays, an inter sheet is fed from another feed tray, so that a job interruption tends not to happen.

An automatic switching mode in which when an inter sheet in one feed tray has run out, a switch is made from that feed tray to another feed tray is convenient, but the automatic switching mode has created a new problem. For example, in a job in which a cover sheet and an insertion sheet are inserted into one sheet group, the cover sheet is stacked on one feed tray, and the insertion sheet is stacked on another feed tray. In the automatic switching mode, when any cover sheets have run out, an insertion sheet is fed instead of a cover sheet. As a result, a sheet group that is not desired by the user is formed.

SUMMARY OF THE INVENTION

The present invention provides an image forming apparatus which may comprise the following elements. A receiving unit is configured to receive a print job. An image forming unit is configured to form an image on a sheet in accordance with the print job received by the receiving unit. A conveyance unit is configured to convey the sheet outputted from the image forming unit. A discharge unit is configured to discharge the sheet conveyed by the conveyance unit. An inserter, which is provided downstream of the image forming unit in a sheet conveyance direction and has a plurality of feed trays, is configured to feed inter sheets placed on each of the feed trays toward the conveyance unit. An operation unit is configured to receive a setting of one of a first mode for permitting automatic switching of the plurality of feed trays and a second mode for prohibiting automatic switching of the plurality of feed trays. A control unit is configured to control the inserter to feed an inter sheet from a feed tray designated by the print job received by the receiving unit. In a case where an inter sheet on the designated feed tray during the execution of the print job has run out, and when the setting received via the operation unit is for the first mode, the control unit switches a feed source from the designated feed tray to another feed tray on which an inter sheet of the same size has been placed and continues the execution of the print job, and when the setting received via the operation unit is for the second mode, interrupts the execution of the print job without switching the feed source from the designated feed tray to another feed tray. In a case where a plurality of feed trays are designated as a feed source for feeding an inter sheet in the print job, the control unit interrupts the execution of the print job without switching the feed source from the feed tray in which the inter sheet has run out to another feed tray even if the setting received via the operation unit is for the first mode.

Further features of the present invention will become apparent from the following description of exemplary embodiments (with reference to the attached drawings).

DESCRIPTION OF THE EMBODIMENTS

Figure 1:
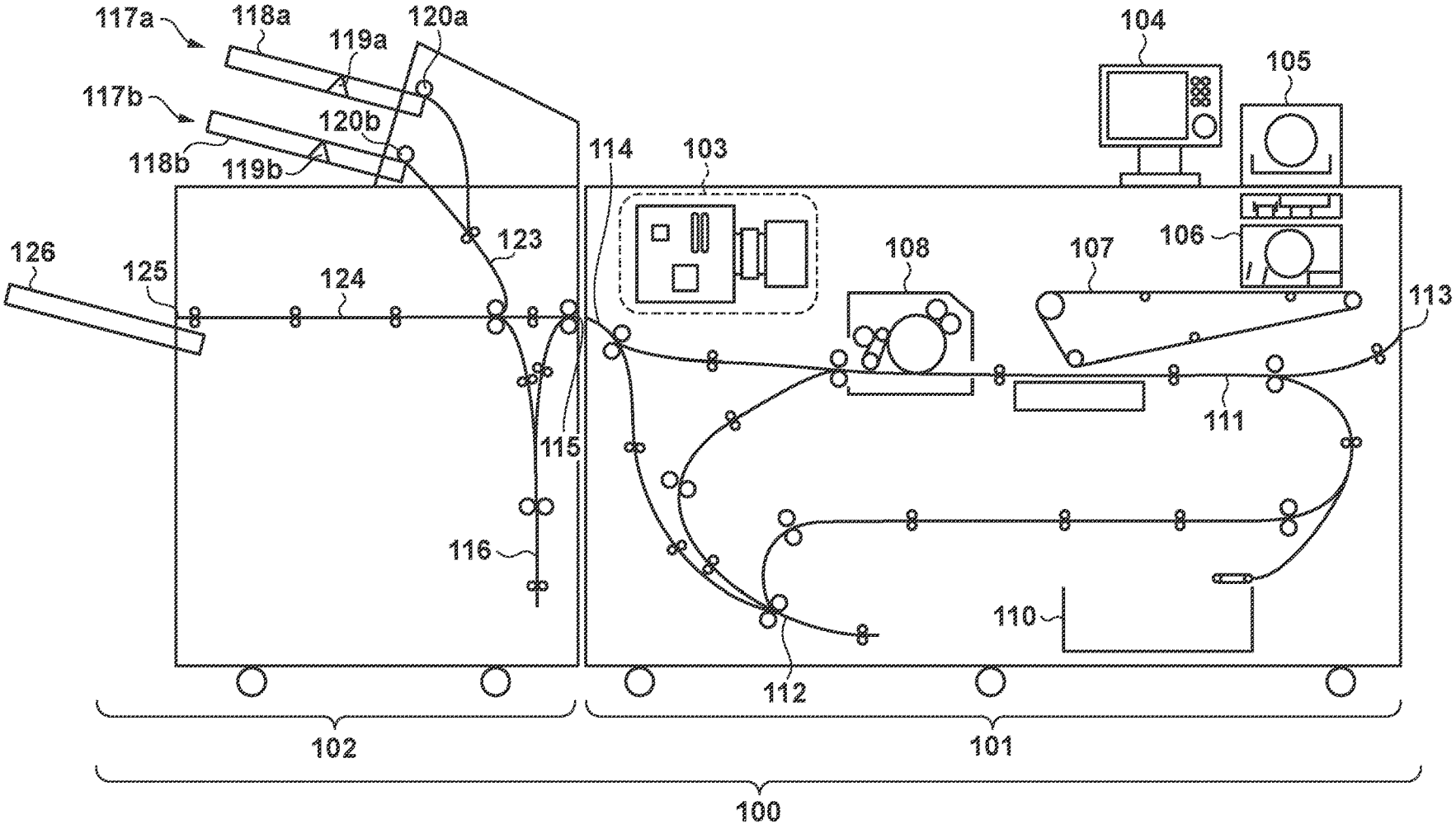
FIG. 1 is a cross-sectional view illustrating an image forming system.

As shown in FIG. 1, an image forming system 100 includes an image forming apparatus 101 and an inserter 102. The image forming apparatus 101 is, for example, a printing apparatus that forms an image on a sheet by using an electrophotographic method, an inkjet recording method, or the like. The inserter 102 has an inserting function of inserting an inter sheet such as a pre-print sheet between a plurality of sheets output from the image forming apparatus 101.

<Image Forming Apparatus>

A controller 103 performs various controls of the image forming system 100. An operation unit 104 includes an input device for receiving an instruction to the image forming system 100, and a display apparatus for outputting information to the user. A toner supply unit 105 supplies toner to an image forming unit 106 of the image forming system 100. The image forming unit 106 forms an image instructed by print data using the toner supplied from the toner supply unit 105, and transfers the image to an intermediate transfer belt 107. The intermediate transfer belt 107 transfers an image to a sheet. A fixing device 108 applies heat and pressure to the sheet onto which the image has been transferred by the intermediate transfer belt 107 to fix the toner onto the sheet. A feed apparatus 110 has a storage container for storing sheets and a feed roller for feeding the sheets to a conveyance path. A sheet conveyance unit 111 conveys a sheet fed from the feed apparatus 110 to the transfer unit or the fixing device 108. A switchback unit 112 reverses the front and back of the sheet on which the image is formed on a first surface, and conveys the sheet to the transfer unit again in order to form an image on the second surface of the sheet. A sheet insertion slot 113 receives a sheet input from an external feed apparatus. A sheet discharge unit 114 discharges the sheet subjected to the fixing process to the inserter 102.

<Inserter>

An insertion slot 115 is an insertion slot of the inserter 102 that receives a sheet discharged from the image forming apparatus 101. A switchback unit 116 is a reversing mechanism for reversing the front and back sides of the sheet. A feed tray 117*a* is an inter sheet feeding unit having a stacking table 118*a* for stacking inter sheets and a feed roller 120*a* for feeding inter sheets. A feed tray 117*b* is an inter sheet feeding unit having a stacking table 118*b* for stacking inter sheets and a feed roller 120*b* for feeding inter sheets. A sheet sensor 119*a* detects whether or not an inter sheet exists in the feed tray 117*a*. A sheet sensor 119*b* detects whether or not an inter sheet exists in the feed tray 117*b*. A conveyance unit 123 functions as an insertion mechanism for inserting an inter sheet into a group of sheets output from the image forming apparatus 101. The conveyance unit 123 includes one or more conveyance rollers that convey the inter sheets fed from the feed trays 117*a* and 117*b* to a conveyance unit 124. The conveyance unit 124 includes one or more conveyance rollers for conveying the sheet supplied from the image forming apparatus 101 and the inter sheet supplied from the conveyance unit 123. In this manner, the sheet supplied from the image forming apparatus 101 and the inter sheet supplied from the conveyance unit 123 converge at the conveyance unit 124. A discharge unit 125 has discharge rollers for discharging the inter sheet and the sheet conveyed by the conveyance unit 124 and stacking the inter sheet and the sheet on a discharge tray 126. In FIG. 1, the discharge tray 126 is connected to the inserter 102, and the discharge tray 126 is a final discharge destination, but this is merely an example. A finisher or the like may be connected to a subsequent stage of the inserter 102, and the finisher may execute post-processing (e.g., bookbinding, stapling). In such a case, the finisher is provided with the discharge tray 126.

<Controller>

Figure 2:
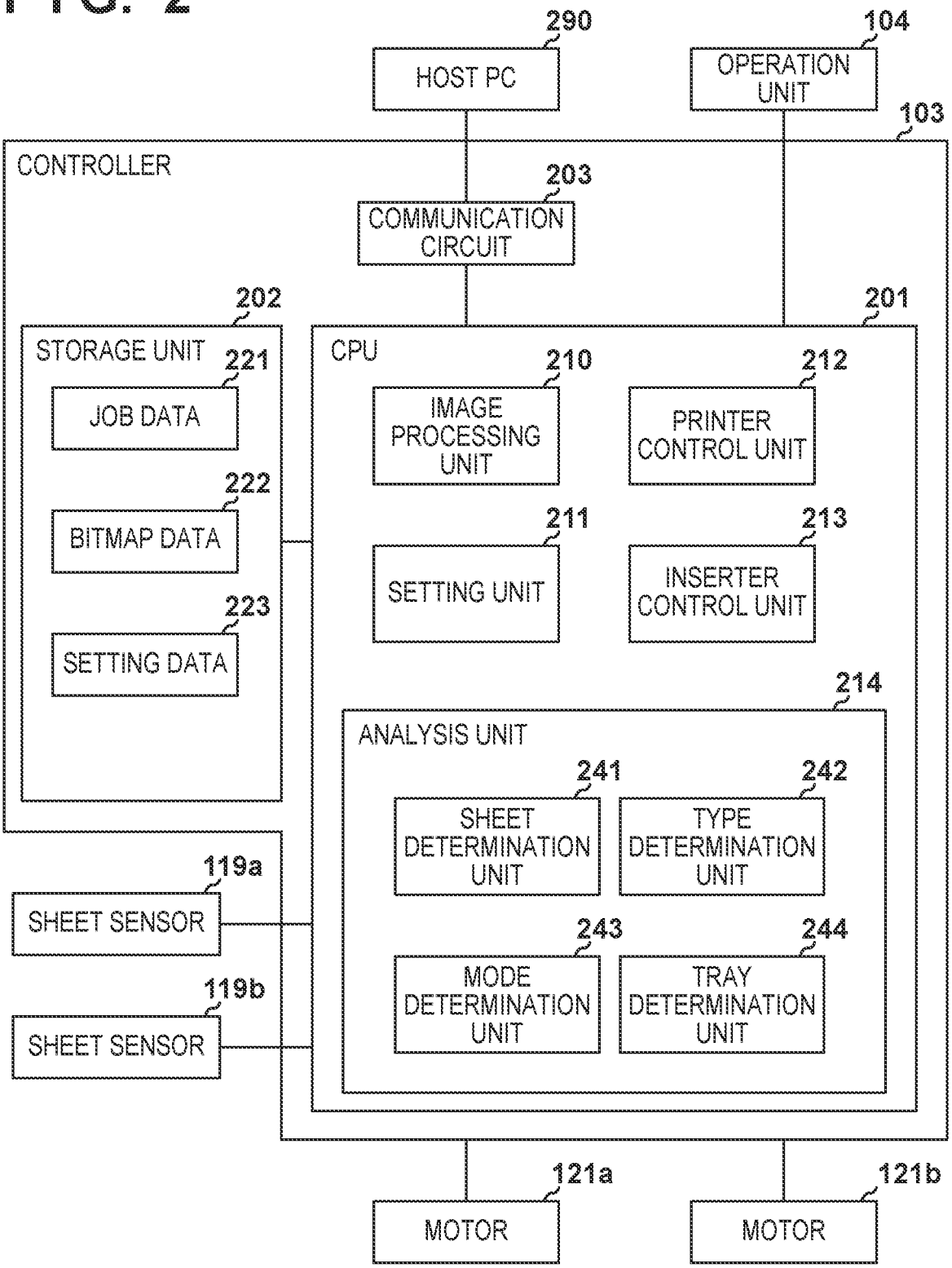
FIG. 2 is a block diagram illustrating a controller.

FIG. 2 shows the function of the controller 103. A CPU 201 implements various functions by executing control programs stored in a ROM of a storage unit 202. However, some or all of these functions may be realized by hardware such as an ASIC or an FPGA. ASIC is an abbreviation for Application Specific Integrated Circuits. FPGA is an abbreviation for Field Programmable Gate Array. ROM is an abbreviation of a read-only memory, but the ROM may be a memory in which stored information can be rewritten. The RAM of the storage unit 202 temporarily stores various data. RAM is an abbreviation for random access memory. Job data 221 is data received from a host PC 290 via a communication circuit 203. PC is an abbreviation for personal computer. The job data 221 defines a job to be executed by the image forming system 100.

An image processing unit 210 rasterizes the print data included in the job data 221 to generate bitmap data 222. A setting unit 211 creates setting data 223 in accordance with instructions input from the operation unit 104 and stores it in the ROM of the storage unit 202. A printer control unit 212 controls the image forming apparatus 101 according to the job data 221 and the setting data 223. In particular, the printer control unit 212 supplies the bitmap data 222 to the image forming apparatus 101, and forms an image corresponding to the bitmap data 222 on a sheet. An inserter control unit 213 controls the inserter 102 according to the job data 221 and the setting data 223. For example, the inserter control unit 213 drives the feed roller 120*a* by driving a motor 121*a*. The inserter control unit 213 drives a motor 121*b* to drive the feed roller 120*b*. An analysis unit 214 analyzes the job data 221 and the setting data 223, and notifies the printer control unit 212 and the inserter control unit 213 of the analysis result. A sheet determination unit 241 determines whether or not there is an inter sheet in the feed tray 117*a* based on a detection result of the sheet sensor 119*a*. The sheet determination unit 241 determines whether or not there is an inter sheet in the feed tray 117*b* based on a detection result of the sheet sensor 119*b*. A type determination unit 242 determines whether or not the type (e.g., size) of the inter sheet stacked on the feed tray 117*a* matches the type of the inter sheet stacked on the feed tray 117*b*. A mode determination unit 243 determines whether or not the automatic switching mode is enabled based on the setting data 223. A tray determination unit 244 determines whether or not both the feeding of the inter sheet from the feed tray 117*a* and the feeding of the inter sheet from the feed tray 117*b* are designated in one job.

<Automatic Switching Setting>

Figure 3A:
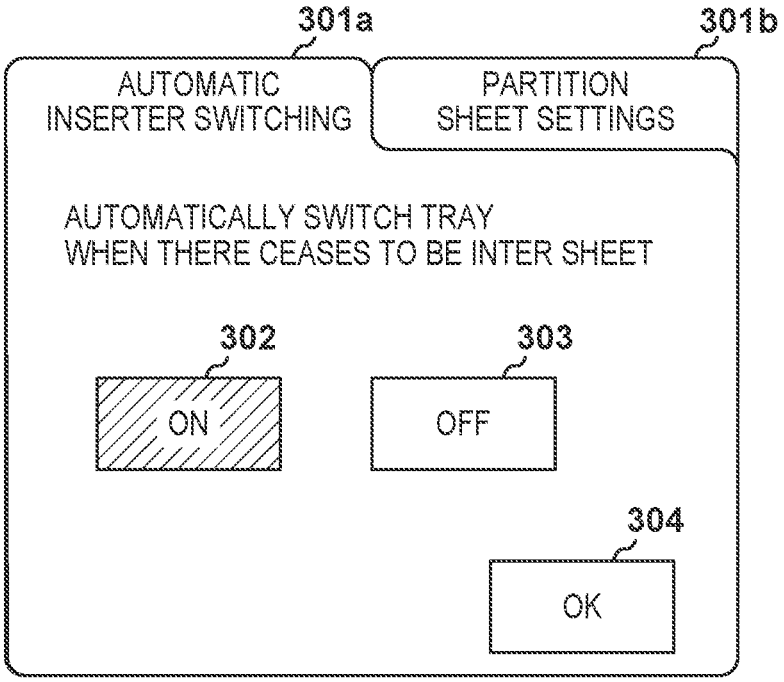
FIGS. 3A and 3B are views illustrating user interfaces.

FIG. 3A shows a tab 301*a* for setting the enabling and disabling of the automatic switching of the feed trays. The setting unit 211 displays the tab 301*a* on the display apparatus of the operation unit 104, and receives an instruction from the user through a touch panel type input device. When it is recognized that an ON button 302 is pressed in the setting unit 211 and then an OK button 304 is pressed, setting information for activating the automatic switching is written to the setting data 223. When the setting unit 211 recognizes that an OFF button 303 is pressed and then the OK button 304 is pressed, the setting information for disabling the automatic switching is written to the setting data 223. As described above, the ON button 302 is a button for enabling automatic switching. The OFF button 303 is a button for disabling automatic switching. When the automatic switching is enabled, the CPU 201 feeds an inter sheet from the feed tray 117*b* when an inter sheet in the feed tray 117*a* has run out. It is assumed that the inter sheet stacking amounts of the feed trays 117*a* and 117*b* are 200 sheets each. In this case, 400 inter sheets can be successively fed. If the automatic switching is disabled, the CPU 201 stops the job when there are no more inter sheets in the feed tray 117*a*.

Figure 3B:
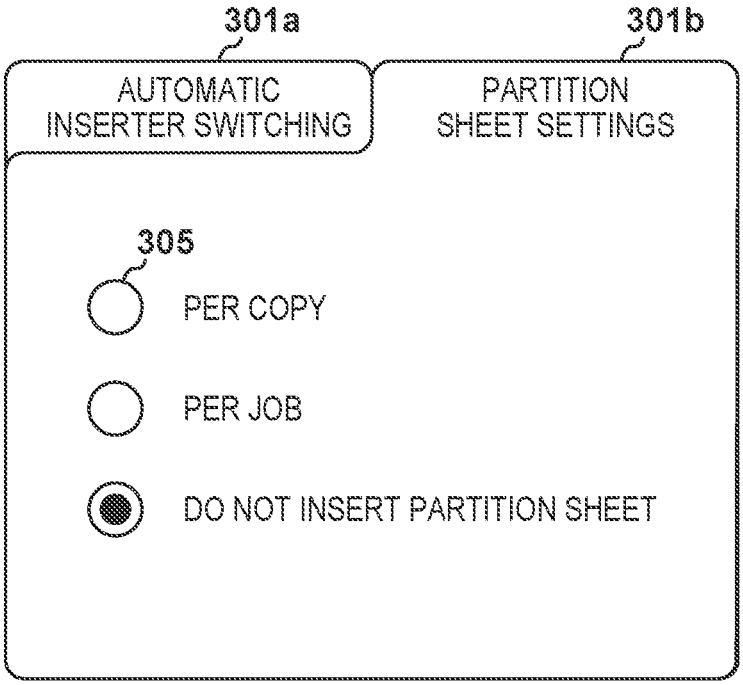

FIG. 3B illustrates a tab 301*b* for receiving sets relating to the partition sheets. By pressing a radio button 305, one of inserting a partition sheet for each copy, inserting a partition sheet for each job, and not inserting a partition sheet is selected. The setting unit 211 writes the setting content of the partition sheet into the setting data 223.

<Job>

Figure 4A:
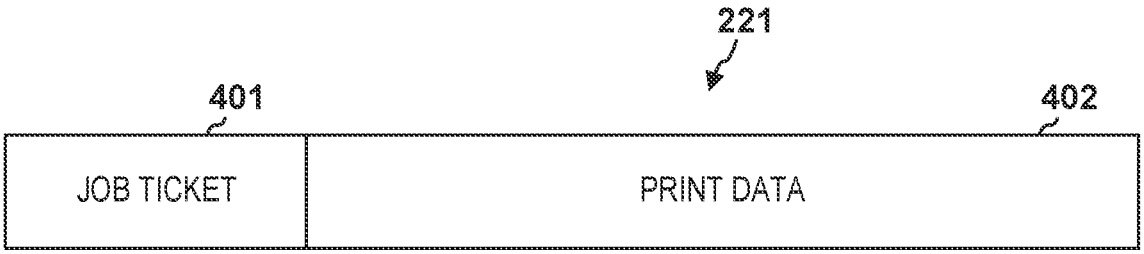
FIGS. 4A and 4B are views illustrating a structure of job data.

As shown in FIG. 4A, the job data 221 includes a job ticket 401 and print data 402. The job ticket 401 includes print settings such as the necessity of double-sided printing, the necessity of stapling, the tray from which to feed an inter sheet serving as a cover sheet, an insertion position, and the like. The print data 402 is data described in, for example, a page description language (PDL).

Figure 4B:
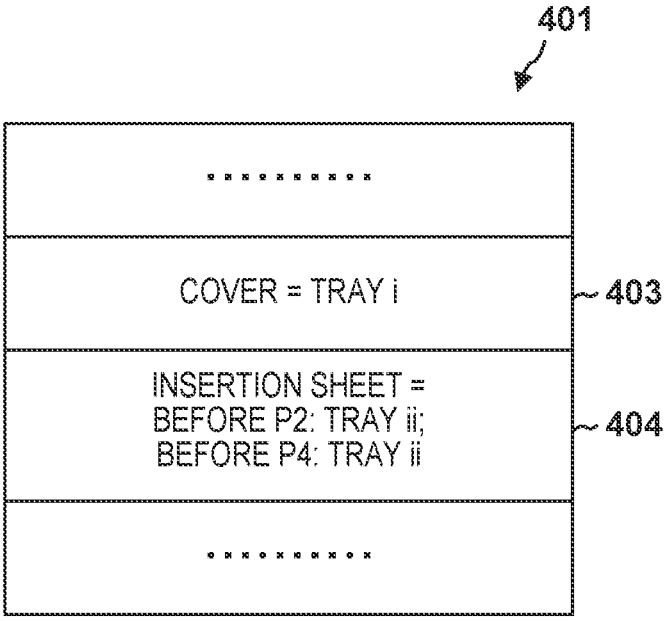

FIG. 4B illustrates the job ticket 401 in detail. A cover sheet setting 403 includes information designating a tray for feeding inter sheets to be a cover sheet. An insertion sheet setting 404 includes information for designating an insertion position of an insertion sheet and information for designating a tray from which to feed the inter sheet to be the insertion sheet. Note that "TRAY i" indicates the feed tray 117*a*. "TRAY ii" indicates the feed tray 117*b*. "BEFORE P2" means that an insertion sheet is inserted before the sheet of the second page. In other words, "BEFORE P2" means that an insertion sheet is inserted between the sheet of the first page and the sheet of the second page. "BEFORE P4" means that an insertion sheet is inserted before the sheet of the fourth page. Here, a tray for feeding inter sheets is designated in the job ticket 401, but a tray for feeding inter sheets may be designated in the print data 402. The print data 402 has attribute data for each page. Therefore, one of the feed trays 117*a* and 117*b* may be designated in the attribute data.

Figure 5A:
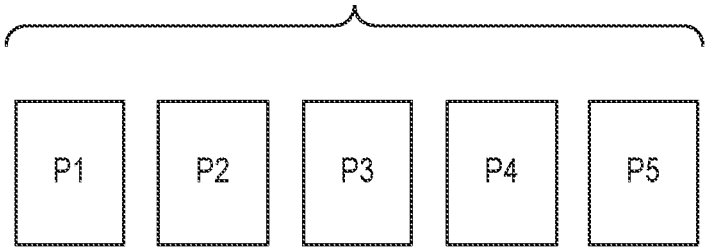
FIGS. 5A to 5C are views illustrating an example of output results.

FIG. 5A illustrates sheets P1 to P5 of the first to fifth pages outputted by the image forming apparatus 101 in accordance with the job data 221. That is, one sheet group is formed from five sheets. The print data 402 includes image data to be printed on each page.

Figure 5B:
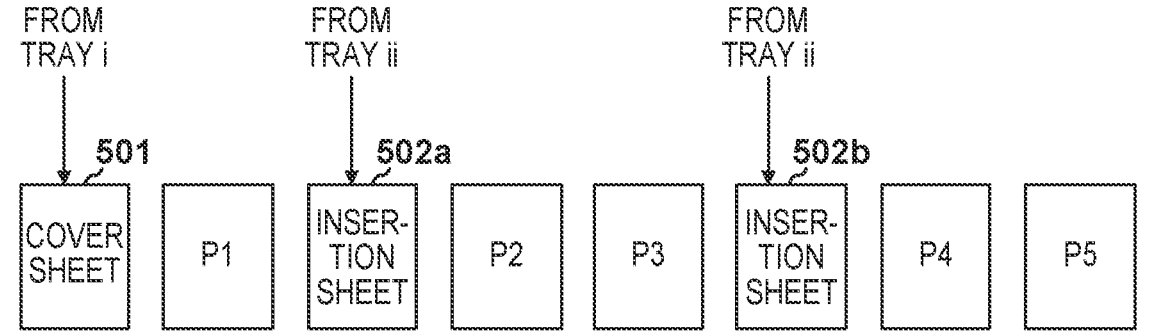

FIG. 5B shows a group of sheets outputted by the inserter 102 in accordance with the job data 221. A cover sheet 501 is fed from the feed tray 117*a* in accordance with a cover sheet setting 403, and is stacked on the discharge tray 126. An insertion sheet 502*a* fed from the feed tray 117*b* is inserted between the sheets P1 and P2 in accordance with the insertion sheet setting 404. Similarly, an insertion sheet 502*b* fed from the feed tray 117*b* is inserted between the sheets P3 and P4 in accordance with the insertion sheet setting 404.

Figure 5C:
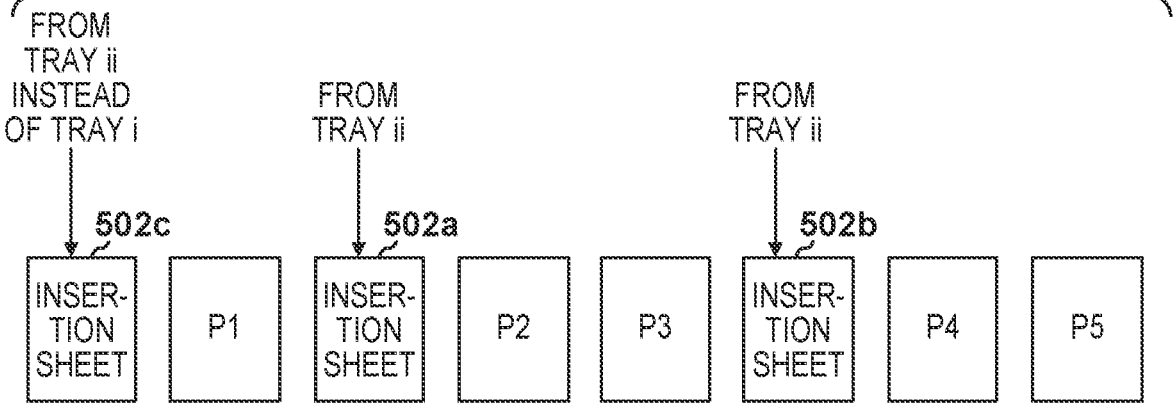

FIG. 5C shows an example in which an insertion sheet was inserted by mistake instead of the cover sheet. In a state in which the automatic switching mode is enabled, there may cease to be an inter sheet (cover sheet) of the feed tray 117*a*. In this case, the inserter control unit 213 switches from the feed tray 117*a* to the feed tray 117*b*, and feeds an inter sheet (insertion sheet) from the feed tray 117*b*. Therefore, an insertion sheet is inserted into a position where actually a cover sheet should be inserted. Since a sheet bundle (sheet group) completed in this manner is not desired by the user, the sheet bundle (sheet group) will end up being discarded. Alternatively, the cover sheet must be replaced by an insertion sheet manually by a person. Since a cover is easily noticeable to the human eye, the user can easily recognize that the cover is incorrect. However, in a case where the insertion sheet 502*a* or the like is replaced with a cover sheet, the user will not be able to immediately recognize the error. As described above, the error of the inter sheet causes an increase in the economical burden on the user and an increase in the work time.

<Flowchart>

Figure 6:
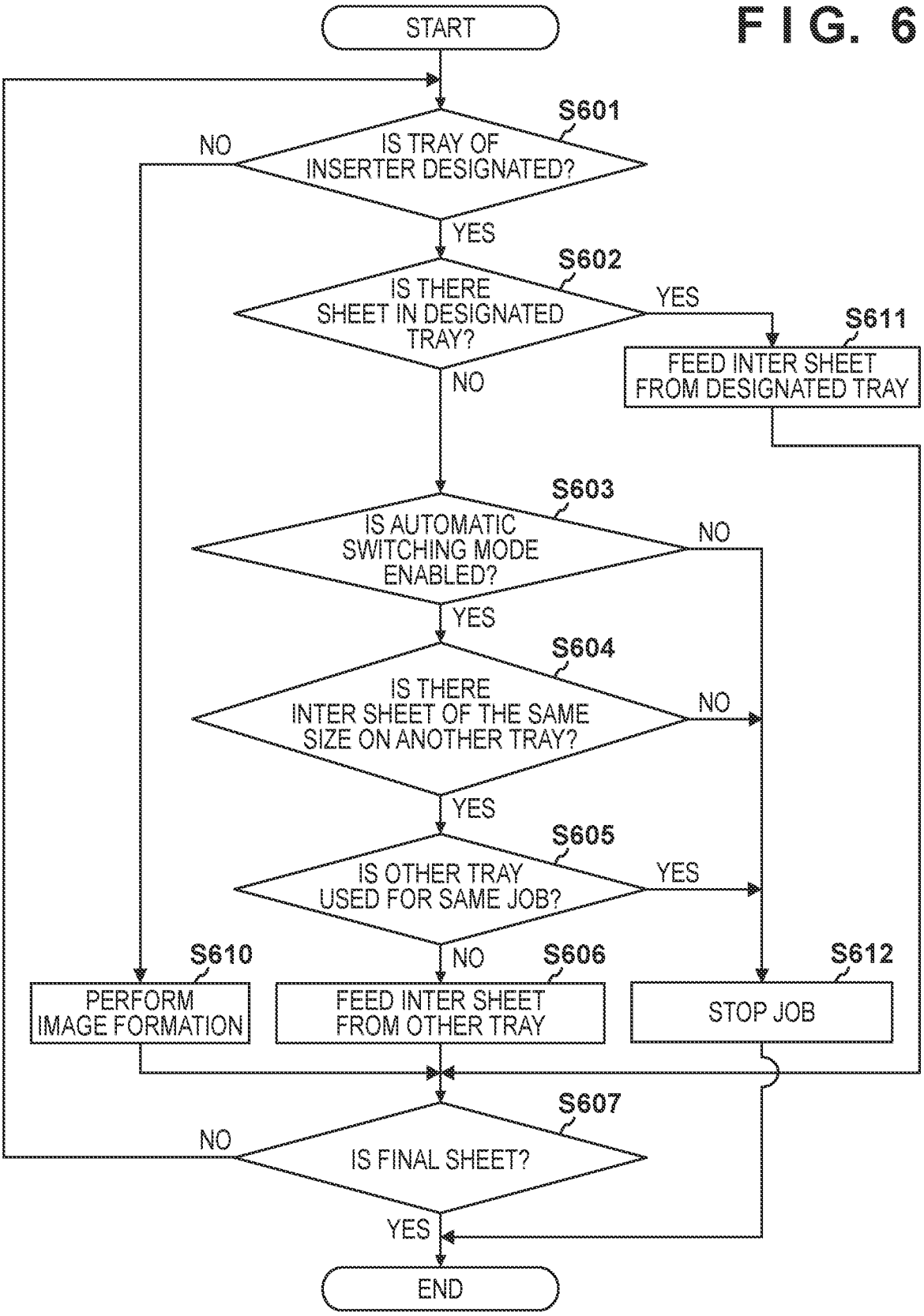
FIG. 6 is a flowchart illustrating processing for executing a job.

FIG. 6 is a flowchart illustrating job execution processing. This execution processing is executed by the CPU 201 in accordance with a control program. Here, for convenience of description, it is assumed that the designated tray is the feed tray 117*a* and the other tray is the feed tray 117*b*.

In step S601, the CPU 201 (the tray determination unit 244) analyzes the job data 221, and determines whether one of the feed trays 117*a* and 117*b* of the inserter 102 is designated as a tray from which to feed a sheet (a sheet of interest) to be stacked on the discharge tray 126.

The case in which neither of the feed trays 117*a* and 117*b* of the inserter 102 is designated is a case in which the feed apparatus 110 or the sheet insertion slot 113 of the image forming apparatus 101 is designated. The tray determination unit 244 analyzes the cover sheet setting 403, the insertion sheet setting 404, and the setting data 223 of the job ticket 401, and determines whether or not a tray of the inserter 102 is designated. It should be noted that feeding of sheets from the feed apparatus 110 or the sheet insertion slot 113 may be designated by the print data 402. In this case, the tray determination unit 244 analyzes the print data 402 to identify or distinguish a tray from which a sheet of interest is to be fed. The feed trays 117*a* and 117*b* may also be designated by the print data 402. If a tray of the inserter 102 is not designated, the CPU 201 proceeds to step S610. In step S610, the CPU 201 (the printer control unit 212 and the inserter control unit 213) controls the image forming apparatus 101 to form an image on the sheet and convey the sheet to the discharge tray 126 for stacking. The CPU 201 then proceeds to step S607. On the other hand, when the step S601 designates a tray of the inserter 102, the CPU 201 proceeds to step S602.

In step S602, the CPU 201 (sheet determination unit 241) determines whether or not there is a sheet (inter sheet) in the tray designated by the job data 221 or the like. If the designated tray is the feed tray 117*a*, the sheet determination unit 241 determines whether or not there is an inter sheet in the feed tray 117*a* based on the detection result of the sheet sensor 119*a*. On the other hand, if the designated tray is the feed tray 117*b*, the sheet determination unit 241 determines whether or not there is an inter sheet in the feed tray 117*b* based on the detection result of the sheet sensor 119*b*. If there is a sheet in the designated tray, the CPU 201 proceeds to step S611. In step S611, the CPU 201 (the inserter control unit 213) feeds an inter sheet by driving a motor that rotates the feed rollers of the designated tray. For example, the inserter control unit 213 drives the motor 121*a* to rotate the feed roller 120*a*, and thereby feeds the inter sheet from the feed tray 117*a*. The CPU 201 then proceeds to step S607. If there are no sheets in the designated tray, the CPU 201 proceeds to step S603.

In step S603, the CPU 201 (the mode determination unit 243) determines whether or not the automatic switching mode is enabled based on the setting data 223. If the automatic switching mode is not enabled, the CPU 201 proceeds to step S612. In step S612, the CPU 201 stops the job. That is, the CPU 201 prohibits automatic switching from the designated tray to another tray. For example, the CPU 201 may output a message to the display apparatus of the operation unit 104, the message indicating that inter sheets have run out or the message prompting the user to replenish the inter sheets. When the sheet sensor 119*a* detects an inter sheet, the CPU 201 may resume the job. If the automatic switching mode is enabled in the step S603, the CPU 201 proceeds to step S604.

In step S604, the CPU 201 (the type determination unit 242) determines whether or not an inter sheet of the same size as that of the inter sheet of the designated tray is present in another tray. The setting data 223 stores information indicating the type (size, basis weight, etc.) of the inter sheet for each feed tray designated through the operation unit 104. In this case, the type determination unit 242 refers to the setting data 223 and determines whether or not the type (size) of the inter sheet of the feed tray 117*a* matches the type (size) of the inter sheet of the feed tray 117*b*. If they do not match, the CPU 201 proceeds to step S612. On the other hand, if they match, the CPU 201 proceeds to step S605. The feed trays 117*a* and 117*b* may be provided with a size sensor for detecting the size of the inter sheet. In this instance, the type determination unit 242 may execute the determination process of step S604 based on a detection result of a size sensor provided in the feed tray 117*a* and a detection result of a size sensor provided in the feed tray 117*b*.

In step S605, the CPU 201 (the tray determination unit 244) analyzes the job data 221 and determines whether another tray is used in the same job. As shown in FIG. 5B, when the plurality of feed trays 117*a* and 117*b* are used in the same job, the feed trays 117*a* and 117*b* may be stacked with different inter sheets. In such a case, even if the types of the inter sheets are the same, inter sheets (such as cover sheets and insertion sheets) may in fact have had different image content printed thereon in advance. Therefore, if both the designated tray and the other tray are designated as trays for feeding inter sheets in the same job, the CPU 201 proceeds to step S612. As a result, it is possible to avoid feeding of an inter sheet unintended by the user from another tray. Meanwhile, if no other tray is used in the same job, the CPU 201 proceeds to step S606.

In step S606, the CPU 201 feeds an inter sheet from the other tray. For example, the analysis unit 214 instructs the inserter control unit 213 to feed the inter sheet from the feed tray 117*b*, which is the other tray. The inserter control unit 213 drives the motor 121*b* in accordance with an instruction, and feeds the inter sheet from the feed tray 117*b*.

In step S607, the CPU 201 determines whether or not the sheet of interest is the final sheet based on the job data 221. If the sheet of interest is the final sheet, the CPU 201 ends the process of executing the job. On the other hand, if the sheet of interest is not the final sheet, the CPU 201 sets the next sheet in the job as the sheet of interest and returns to step S601.

<Variation>

As described above, the feed tray may be designated by the attribute data of each page in the print data 402. The image processing unit 210 can start rasterization before reception of all the print data 402 is completed. For example, if reception of the print data of the sheet P1 is completed, the image processing unit 210 can perform rasterization of the sheet P1 without waiting for the print data of the sheet P2. In the case of a job consisting of a large number of sheets, there may be a page fed from the inserter 102 for print data that has not yet been received. That is, while one feed tray is designated in the job ticket 401, another feed tray may be designated in the print data 402. Therefore, the tray determination unit 244 acquires the designation information of the feed trays 117*a* and 117*b* confirmed by the rasterization of the print data 402 in the image processing unit 210, and stores the designation information in the RAM of the storage unit 202. Similarly, the tray determination unit 244 also stores the designation information of the feed trays 117*a* and 117*b*, which is confirmed from the job ticket 401, in the RAM of the storage unit 202. In step S605, the tray determination unit 244 may determine whether or not another tray is used in the same job by determining whether or not designation information for two or more feed trays is stored in the RAM of the storage unit 202. For example, it may be that the feed tray 117*a* is designated in the job ticket 401, but the feed tray 117*b* is not designated. On the other hand, the feed tray 117*b* may be designated in the print data 402. In such a case, the tray determination unit 244 determines that another tray is used in the same job. The inserter 102 may insert an inter sheet (a partition sheet) between the sheet group formed by the preceding job and the subsequent sheet group. Further, when the image forming apparatus 101 outputs a designated number of copies, the inserter 102 may insert inter sheets in order to divide each copy. Whether to insert these partition sheets may be set by the job data 221 or may be set through the operation unit 104. In the latter case, the setting unit 211 stores, in the setting data 223, designation information for designating the insertion position of a partition sheet. Accordingly, in step S605, the tray determination unit 244 may analyze the setting data 223 in addition to the job data 221 to determine whether or not another tray is set to insert an inter sheet (such as a partition sheet). When the setting data 223 indicates that another tray is set to insert a partition sheet, the tray determination unit 244 prohibits switching of the feed tray and stops the job. If another tray is not used in the same job and is not set to insert a partition sheet, the tray determination unit 244 tolerates or permits feed tray switching.

Figure 7A:
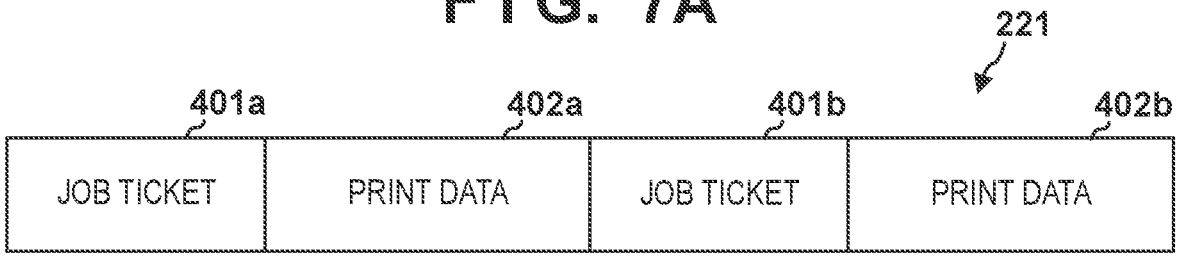
FIGS. 7A to 7C are views illustrating a structure of job data.
Figure 7B:
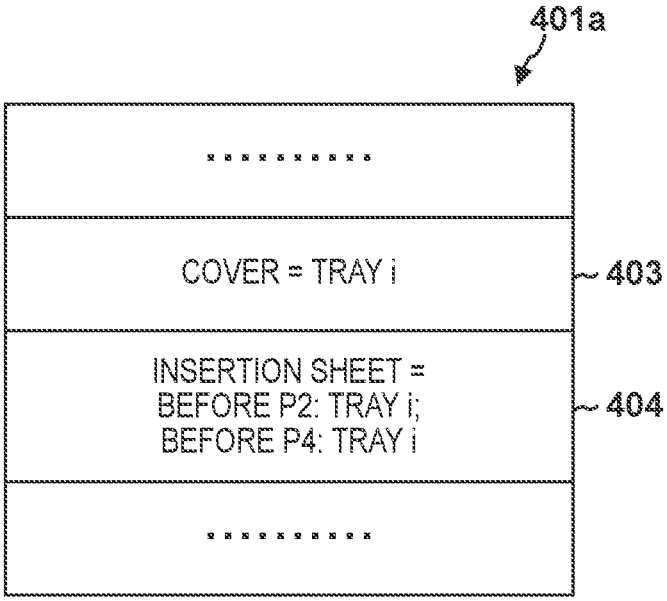
Figure 7C:
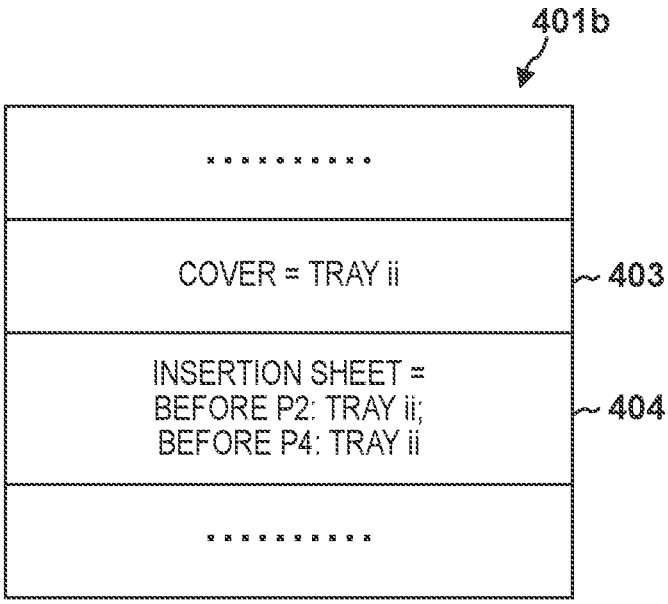

As shown in FIG. 7A, a print job may be defined by the job data 221 including a plurality of pieces of designation information for designating a feeding unit for feeding an inter sheet, and a plurality of pieces of image data indicating images formed on the sheets. The plurality of pieces of designation information are, for example, job tickets 401*a* and 401*b*. The plurality of image data are, for example, print data 402*a* and 402*b*. In this case, the image processing unit 210 can start the image forming processing before the reception of all the job data 221 is completed. As shown in FIG. 7A, it may be that the reception of the job ticket 401*a* and the print data 402*a* in the job data 221 has completed, and the reception of the job ticket 401*b* and the print data 402*b* has not completed. In this case, the image processing unit 210 can start the image forming process for the job ticket 401*a* and the print data 402*a*. However, as shown in FIG. 7B, there are cases where the job ticket 401*a* designates TRAY i, but as shown in FIG. 7C, the job ticket 401*b* designates TRAY ii. That is, the tray designated by the received job ticket 401*a* and the tray designated by the yet to be received job ticket 401*b* are different from each other.

Figure 8:
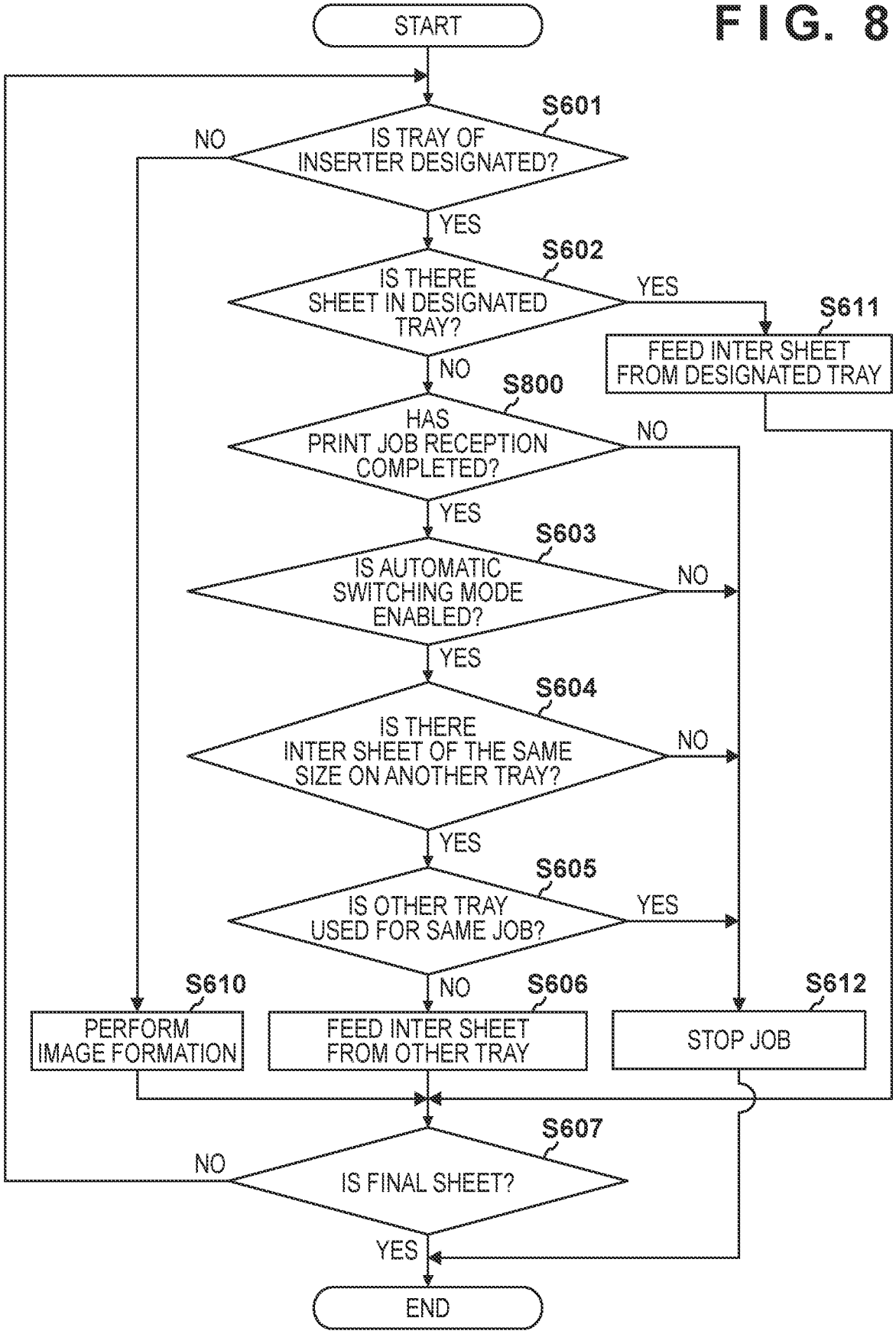
FIG. 8 is a flowchart illustrating processing for executing a job.

Therefore, as shown in FIG. 8, step S800 may be added between step S602 and step S603. In step S602, if the CPU 201 determines that there are no more sheets in the designated trays, it proceeds to step S800.

In step S800, the CPU 201 determines whether the reception of the print job (the job data 221) is completed. If the reception of the print job is completed, the CPU 201 advances the process to step S603. On the other hand, if the reception of the print job is not completed, the CPU 201 advances the process to step S612. In step S612, the CPU 201 stops the job regardless of the determination result of the mode determination unit 243.

The CPU 201 may resume the print job when the reception of the job data 221 is completed, or when it is detected that sheets are stacked on the designated tray. In this manner, the CPU 201 may interrupt execution of the print job when the receiving unit has no inter sheet during the reception of a print job. When execution of the print job is interrupted, the CPU 201 waits until the receiving unit completes the reception of the print job. When the reception of the print job is completed during the interruption of the print job, the CPU 201 determines whether a setting received via the operation unit is for the first mode. If the setting is for the first mode, the CPU 201 switches the feed source from the designated feed tray to another feed tray on which inter sheets of the same size are placed, and resumes the print job.

SUMMARY

The image forming system 100 may be referred to as an image forming apparatus. The image forming apparatus 101 and the image forming unit 106 are examples of an image forming unit that forms an image on a sheet according to a job. The conveyance unit 124 is an example of a conveyance unit that conveys a sheet output from the image forming unit. The discharge tray 126 is an example of a stacking unit that stacks a sheet conveyed by the conveyance unit. The feed tray 117*a* is an example of a first feeding unit that feeds a first inter sheet. The feed tray 117*b* is an example of a second feeding unit that feeds a second inter sheet. The inserter 102 and the conveyance unit 123 are an example of an insertion unit that, by feeding the first inter sheet from the first feeding unit before a sheet is stacked on the stacking unit, inserts the first inter sheet under the sheet. The inserter 102 and the conveyance unit 123 may, by feeding the second inter sheet from the second feeding unit, insert the second inter sheet under a sheet. The sheet sensor 119*a* is an example of a detection unit that detects whether or not the first inter sheet is present in the first feeding unit. The controller 103 is an example of a control unit that controls the first feeding unit, the second feeding unit, and the insertion unit according to a job. As described with respect to the step S602, the detection unit may detect that the first inter sheet is not present in the first feeding unit. In some cases, the job designates feeding of the first inter sheet from the first feeding unit and the job designates feeding of the second inter sheet from the second feeding unit. In this case, the controller 103 prohibits switching from the first feeding unit to the second feeding unit. In some cases, the job designates that the first inter sheet is fed from the first feeding unit, and the job does not designate that the second inter sheet is fed from the second feeding unit. In this case, the controller 103 permits switching from the first feeding unit to the second feeding unit. As a result, it is possible to reduce a case in which an inter sheet which is not intended by the user is inserted into a sheet group.

The tray determination unit 244 is an example of a determination unit for determining whether or not feeding of the first inter sheet from the first feeding unit and feeding of the second inter sheet from the second feeding unit are designated in the job. The inserter control unit 213 of the controller 103 may prohibit or permit the switching from the first feeding unit to the second feeding unit based on the determination result of the determination unit.

The input device of the operation unit 104 and the setting unit 211 are examples of a reception unit that receives settings of the image forming system 100. There are cases where, when a first control mode for feeding the second inter sheet from the second feeding unit instead of the first inter sheet when a first inter sheet has run out is selected by the reception unit, the first inter sheet ceases to be in the first feeding unit. In such a case, the tray determination unit 244 may determine whether the job designates feeding of the first inter sheet from the first feeding unit and feeding of the second inter sheet from the second feeding unit.

The inserter control unit 213 may prohibit or permit switching from the first feeding unit to the second feeding unit based on the determination result of the determination unit. The inserter control unit 213 may stop the job when the first inter sheet in the first feeding unit has run out when a second control mode for stopping the job when the first inter sheet has run out is selected by the reception unit. This is illustrated by the case where step S603 is NO.

The tray determination unit 244 may further determine whether feeding of a partition sheet from the second feeding unit is designated based on the setting data 223 of the image forming system 100. It may be the case that although the job designates that the first inter sheet is to be fed from the first feeding unit and does not designate that the second inter sheet is to be fed from the second feeding unit, the setting data 223 designates that a partition sheet is to be fed from the second feeding unit. In this case, the inserter control unit 213 may prohibit switching from the first feeding unit to the second feeding unit. In some cases, the job designates feeding of the first inter sheet from the first feeding unit, does not designate feeding of the second inter sheet from the second feeding unit, and does not designate feeding of the partition sheet from the second feeding unit by the setting data. In this case, the inserter control unit 213 may permit switching from the first feeding unit to the second feeding unit.

The partition sheet is an inter sheet inserted between a first sheet group stacked on the stacking unit by a first job and a second sheet group stacked on the stacking unit by a second job different from the first job. Alternatively, the partition sheet may be an inter sheet inserted between a first sheet group stacked on the stacking unit by a job and a second sheet group stacked on the stacking unit by the job. This is the case where the content of the first sheet group and the content of the second sheet group are the same. For example, there is a case where a plurality of copies are made from the same original.

The job may be defined by job data 221 having designation information (e.g., job ticket 401) designating a feeding unit for feeding an inter sheet and image data (e.g., print data 402) formed on the sheet. The tray determination unit 244 may analyze the designation information to determine that the first inter sheet is designated to be fed from the first feeding unit and that the second inter sheet is designated to be fed from the second feeding unit. The first inter sheet may be a cover of a group of sheets formed by the job.

As described with respect to step S604, the inserter control unit 213 may prohibit switching from the first feeding unit to the second feeding unit if the size of the first inter sheet differs from the size of the second inter sheet, regardless of the job. The inserter control unit 213 may stop the job when switching from the first feeding unit to the second feeding unit is prohibited when the first inter sheet has run out.

After the switching from the first feeding unit to the second feeding unit is prohibited, the inserter control unit 213 and the sheet determination unit 241 may resume the job when the detection unit detects that the first inter sheet has been replenished in the first feeding unit. This makes it possible to resume the job quickly. In addition, since the same feeding unit is continuously used, there is less possibility that an incorrect inter sheet will be inserted.

The display apparatus of the operation unit 104 may function as an output unit that outputs a message prompting the user to replenish the first feeding unit with the first inter sheet when switching from the first feeding unit to the second feeding unit is prohibited, due to exhaustion of the first inter sheet. This will allow the user to quickly replenish inter sheets.

The inserter 102 is an example of an inserter apparatus. The conveyance unit 124 is an example of a conveyance unit that conveys a sheet discharged from the image forming apparatus 101. The discharge tray 126 is an example of a stacking tray for stacking sheets conveyed by the conveyance unit. The feed tray 117*a* is an example of a first feed tray for stacking first inter sheets and feeding the first inter sheets. The feed tray 117*b* is an example of a second feed tray for stacking second inter sheets and feeding the second inter sheets. The sheet sensor 119*a* is an example of a sheet sensor that detects whether or not a first inter sheet is present in the first feed tray. The inserter 102 is configured to, so that an inter sheet fed from the first feed tray or the second feed tray is inserted under a sheet on a stacking tray, stack the inter sheet on the stacking tray before the sheet is stacked on the stacking tray. It may be detected by a sheet sensor that the first inter sheet is not present even though the first inter sheet is designated to be inserted under a first sheet by a job or image forming system setting data. In this case, the controller 103 determines whether or not insertion of a second inter sheet under a second sheet is designated in the job or setting data. The controller 103 stops the job when it is designated to insert the second inter sheet under the second sheet. Also, the controller 103, when the insertion of the second inter sheet under the second sheet has not been designated, controls the inserter apparatus so that the second inter sheet is inserted under the first sheet instead of the first inter sheet. The first sheet and the second sheet may be the same or different.

The communication circuit 203 is an example of a receiving unit that receives a print job. The image forming unit 106 is an example of an image forming unit that forms an image on a sheet in accordance with a print job received by the receiving unit. The discharge unit 125 is an example of a discharge unit that discharges a sheet conveyed by the conveyance unit. The inserter 102 is an example of an inserter that is provided downstream of the image forming unit in the sheet conveyance direction, has a plurality of feed trays, and feeds inter sheets placed on the respective feed trays toward the conveyance unit. The operation unit 104 is an example of an operation unit that receives setting of one of a first mode in which automatic switching of a plurality of feed trays is permitted and a second mode in which automatic switching of a plurality of feed trays is prohibited. The controller 103 is an example of a control unit that controls the inserter to feed an inter sheet from a feed tray designated by a print job received by the receiving unit. During execution of a print job, there may cease to be an inter sheet on the designated feed tray. In this case, when the setting received via the operation unit is the first mode, the controller 103 switches the feed source from the designated feed tray to another feed tray on which an inter sheet of the same size is placed, and continues the execution of the print job. When a setting received via the operation unit is for the second mode, the controller 103 interrupts the execution of the print job without switching the feed source from the designated feed tray to another feed tray. In a print job, a plurality of feed trays may be designated as a feed source for feeding inter sheets. In this case, even if the setting received via the operation unit is for the first mode, the controller 103 interrupts the execution of the print job without switching the feed source from the feed tray in which an inter sheet has run out to another feed tray. The controller 103 may resume the print job when it detects that the designated feed tray has been replenished with an inter sheet while the execution of the print job is interrupted.

The display apparatus of the operation unit 104 is an example of a display unit that displays a message prompting the user to replenish the designated feed tray with the inter sheet when the execution of the print job is interrupted due to exhaustion of the inter sheet on the designated feed tray. The controller 103 may interrupt the execution of the print job even when the setting received via the operation unit is for the first mode and there is no feed tray on which an inter sheet of the same size is placed. The inter sheet may be a cover of a group of sheets formed by a print job. The inter sheet may be an insertion sheet to be inserted between sheets formed by a print job.

Even when a plurality of feed trays have not been designated in the print job, the feeding of a partition sheet may have been set based on setting data of the image forming apparatus. In such a case, the controller 103 may disable the first mode and interrupt the execution of the print job when an inter sheet has run out. The partition sheet may be a partition sheet to be inserted between the print jobs. The partition sheet may be a partition sheet to be inserted every designated number of copies.

Other Embodiments

Embodiment(s) of the present invention can also be realized by a computer of a system or apparatus that reads out and executes computer executable instructions (e.g., one or more programs) recorded on a storage medium (which may also be referred to more fully as 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™, a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-128567, filed Jul. 5, 2018 and Japanese Patent Application No. 2019-029567, filed Feb. 21, 2019, which are hereby incorporated by reference herein in their entirety.

What is claimed is:

1. An image forming apparatus comprising:

a receiving unit configured to receive a print job;

an image forming unit configured to form an image on a sheet in accordance with the print job received by the receiving unit;

a conveyance unit configured to convey the sheet outputted from the image forming unit;

a discharge unit configured to discharge the sheet conveyed by the conveyance unit;

an inserter which is provided downstream of the image forming unit in a sheet conveyance direction and has a plurality of feed trays, and is configured to feed inter sheets placed on each of the feed trays toward the conveyance unit;

an operation unit configured to receive a setting of one of a first mode for permitting automatic switching of the plurality of feed trays and a second mode for prohibiting automatic switching of the plurality of feed trays; and a control unit configured to control the inserter to feed an inter sheet from a feed tray designated by the print job received by the receiving unit, wherein in a case where an inter sheet on the designated feed tray during the execution of the print job has run out, and when the setting received via the operation unit is for the first mode, the control unit switches a feed source from the designated feed tray to another feed tray on which an inter sheet of the same size has been placed and continues the execution of the print job, and when the setting received via the operation unit is for the second mode, interrupts the execution of the print job without switching the feed source from the designated feed tray to another feed tray, and in a case where a plurality of feed trays are designated as a feed source for feeding an inter sheet in the print job, the control unit interrupts the execution of the print job without switching the feed source from the feed tray in which the inter sheet has run out to another feed tray even if the setting received via the operation unit is for the first mode.

2. The image forming apparatus according to claim 1, wherein the control unit resumes the print job when the control unit detects that the designated feed tray has been replenished with an inter sheet while the execution of the print job is interrupted.

3. The image forming apparatus according to claim 1, further comprising a display unit configured to display a message prompting a user to replenish the designated feed tray with an inter sheet when the execution of the print job is interrupted due to the designated feed tray being out of an inter sheet.

4. The image forming apparatus according to claim 1, wherein even if the setting received via the operation unit is for the first mode, the control unit interrupts the execution of the print job when there is no feed tray on which an inter sheet of the same size is placed.

5. The image forming apparatus according to claim 1, wherein the inter sheet is a cover of a group of sheets formed by the print job.

6. The image forming apparatus according to claim 1, wherein of the inter sheet is an insertion sheet that is inserted between sheets formed by the print job.

7. The image forming apparatus according to claim 1, wherein even when a plurality of feed trays have not been designated in the print job, the control unit disables the first mode in a case where a setting has been made to feed a partition sheet based on the setting data of the image forming apparatus, and interrupts the execution of the print job when an inter sheet has run out.

8. The image forming apparatus according to claim 7, wherein the partition sheet is a partition sheet inserted between print jobs.

9. The image forming apparatus according to claim 7, wherein the partition sheet is a partition sheet to be inserted every designated number of copies.

10. The image forming apparatus according to claim 1, wherein the control unit interrupts the execution of the print job if an inter sheet has run out during reception of the print job by the receiving unit.

11. The image forming apparatus according to claim 10, wherein the control unit, when the receiving unit completes reception of the print job while the print job is interrupted, determines whether or not the setting received via the operation unit is for the first mode, and if the setting received via the operation unit is for the first mode, the feed source is switched from the designated feed tray to another feed tray on which an inter sheet of the same size is placed, and the print job is resumed.

12. A method of controlling an image forming apparatus, the apparatus comprising:

a receiving unit configured to receive a print job;

an image forming unit configured to form an image on a sheet in accordance with the print job received by the receiving unit;

a conveyance unit configured to convey the sheet outputted from the image forming unit;

a discharge unit configured to discharge the sheet conveyed by the conveyance unit;

an inserter which is provided downstream of the image forming unit in a sheet conveyance direction and has a plurality of feed trays, and is configured to feed inter sheets placed on each of the feed trays toward the conveyance unit; and an operation unit for receiving a setting of one of a first mode for permitting automatic switching of the plurality of feed trays and a second mode for prohibiting automatic switching of the plurality of feed trays, the method comprising:

in a case where an inter sheet on the feed tray designated by the print job during the execution of the print job has run out, and when the setting received via the operation unit is for the first mode, switching a feed source from the designated feed tray to another feed tray on which an inter sheet of the same size has been placed and continuing the execution of the print job, and when the setting received via the operation unit is for the second mode, interrupting the execution of the print job without switching the feed source from the designated feed tray to another feed tray; and in a case where a plurality of feed trays are designated as a feed source for feeding an inter sheet in the print job, interrupting the execution of the print job without switching the feed source from the feed tray in which the inter sheet to has run out to another feed tray even if the setting received via the operation unit is for the first mode.

* * * * *